US005553844A

United States Patent [19]

Aaron

[11] Patent Number: 5,553,844

[45] Date of Patent: Sep. 10, 1996

[54] SHEET SORTING APPARATUS

[76] Inventor: Jack Aaron, 17231 Corla Ave., Tustin, Calif. 92680

[21] Appl. No.: 317,683

[22] Filed: Oct. 6, 1994

[51] Int. Cl.[6] ..... B65H 39/10

[52] U.S. Cl. ..... 271/293; 271/288

[58] Field of Search ..... 271/288, 292, 271/293, 294, 298

[56] References Cited

U.S. PATENT DOCUMENTS

| | | | |
|---|---|---|---|
| 3,848,868 | 11/1974 | Stemmle | 271/293 |
| 4,603,850 | 8/1986 | Horiuchi | 271/288 |
| 4,638,992 | 1/1987 | Johdai et al. | 271/294 |
| 4,671,505 | 6/1987 | Hidaka | 271/294 |
| 4,777,365 | 10/1988 | Torii et al. | 271/293 |
| 4,781,371 | 11/1988 | Stemmle | 271/294 |
| 4,843,434 | 6/1989 | Lawrence et al. | 271/293 |
| 4,911,424 | 3/1990 | Lawrence | 271/294 |
| 5,011,131 | 4/1991 | Maier et al. | 271/293 |
| 5,305,994 | 4/1994 | Matsui et al. | 271/294 |

*Primary Examiner*—H. Grant Skaggs
*Attorney, Agent, or Firm*—Herbert M. Shapiro

[57] ABSTRACT

A movable tray paper sorter includes mechanical and electronic controls for moving, in each paper delivery operation, both the tray set and the paper chute characteristic of such sorters. The trays of the tray set are oriented almost vertically and move along a horizontal axis. The paper chute travels along the same horizontal axis beneath the tray set for delivering a sheet of paper from beneath the trays. The sorter includes a moving finger arrangement and tray lip configuration for ensuring proper paper placement and retention in a tray.

16 Claims, 8 Drawing Sheets

SHEET SORTING APPARATUS

FIELD OF THE INVENTION

This invention relates to paper sheet processing machines and, more particularly, to compact paper sheet sorting apparatus of the movable tray type.

BACKGROUND OF THE INVENTION

A variety of paper sorting machines exists for receiving and sorting sheets of paper from an output slot of, for example, a document copier. Such sheet sorters are of a fixed tray or a movable tray type. With the fixed tray type, all the trays are separated by a fixed and relatively large distance from one another and a movable paper chute delivers the document to a selected tray or to the trays in sequence. Due to the large separation between trays, the fixed tray sorters are large.

The movable tray type sorter is more compact than the fixed tray type. The movable tray type sorter has a set of trays which is arranged in a compact stack with very little separation between the trays of the stack. In such sorters, the trays are moved past a fixed position at which the paper chute is secured. As each tray moves to the position of the paper chute, the separation between the tray at the paper chute position and the next adjacent tray increases to permit movement of a sheet of paper into the selected tray.

A plethora of problems plague sorters of the movable tray type. These problems relate to the movement of the trays where the capacity of the sorter depends on how physically robust the mechanical structure of the sorter is made. But the more robust the mechanical structure, the slower the operation and the more expensive the machine. One patent which addresses this problem is U.S. Pat. No. 4,343,462 issued to Lawrence on Aug. 10, 1982. The sorter disclosed in that patent employs two rotating cam shafts operative to move the trays sequentially past a paper chute in a fixed position. The Lawrence patent is representative of a large number of patents directed to the issue of paper tray movement.

Other problems relating to movable bin or tray type sorters involve the placement and retention of multiple sheets of paper in the trays, the speed of tray movement, and the simplification of the tray selection and movement control to provide a reliable and yet inexpensive paper sorter.

These problems are more acute in sorters where the trays are oriented in an almost vertical orientation rather in a stack of horizontally oriented trays. The relative lack of commercial success of sorters with vertically oriented trays is testimony to the failure to successfully resolve some of the outstanding problems with such sorters.

BRIEF DESCRIPTION OF THE INVENTION

The present invention is directed at a movable tray sorter which includes a plurality of trays in a tray set each tray in which is oriented almost vertically and which is movable along a horizontal axis. The sorter also includes a paper chute which delivers a paper sheet to a selected tray of the tray set from beneath the tray set. Importantly, both the tray set and the paper chute move, in accordance with the principles of this invention, thus allowing an implementation to be realized which is both robust mechanically and reliable and yet inexpensive and compact.

The system for moving both the trays and the paper chute for the delivery of each sheet of paper to the trays of the tray set is considered a significant departure from prior art thinking and has led to impressive and reliable prototype operation of sorters operative in accordance with the principles of this invention.

DETAILED DESCRIPTION OF AN ILLUSTRATIVE EMBODIMENT OF THIS INVENTION

In a preferred embodiment of this invention, the tray set moves only one position each time a paper sheet is delivered to a different tray and in each instance of such a delivery, the separation between a selected tray and the next adjacent tray is increased. The paper chute is moved to the position of the selected tray wherever that tray is located. Thus, both the tray set and the paper chute move during each paper delivery operation. Further, there is no home position for the paper chute. Rather, the paper chute is moved from it's last location to that of a newly selected tray during each operation and the tray set is moved (one tray position) to permit an increase in the space between the selected tray and the next adjacent tray in order to receive a sheet of paper.

The basic operation of the sorter herein thus requires the movement of the tray set only to the extent of opening the space between the two adjacent trays at the position of the selected tray and the movement of the paper chute to the position at which the increased space is provided. To this end, travelling wedges move along a rod positioned, illustratively, along each side of the trays. The position to which the wedges are moved is determined by an electronic control, illustratively employing a binary code, to move the wedges from the next preceeding position to the selected position. The gantry for containing the tray set thus need only be sufficiently large to contain the tray set without any space between the trays plus an additional space equal to the maximum space required between the trays at the selected position to receive a sheet of paper.

The only additional mechanism is the one required for positioning the paper chute at the selected position. The positioning mechanism for the paper chute is operative also to move the chute from a preceeding position to the newly selected position and, in the illustrative embodiment, is mechanically coupled to the wedge positioning subassembly.

Figure 1:
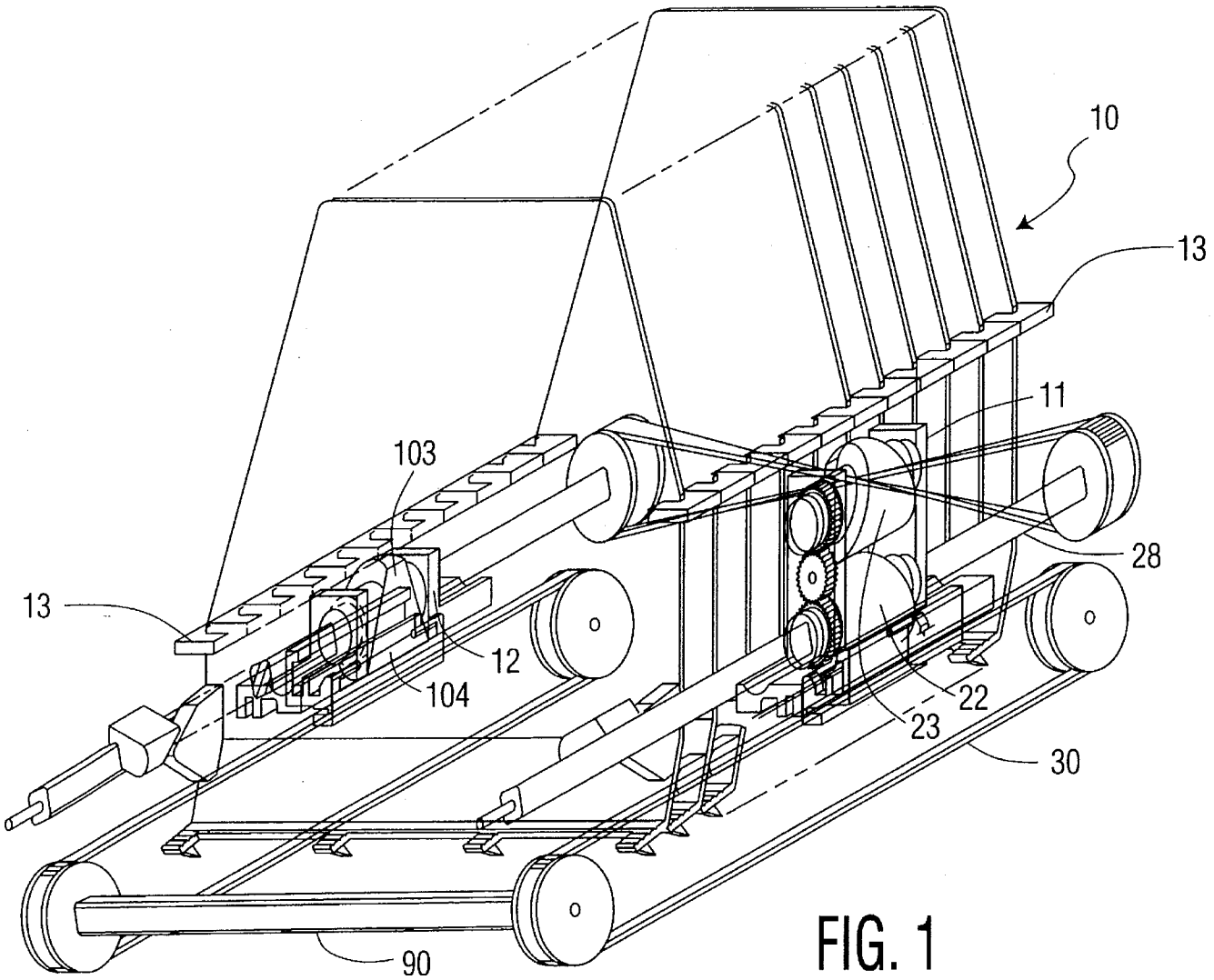
FIG. 1 is a schematic perspective view of a movable tray assembly of a sorter in accordance with the principles of this invention.

More specifically, FIG. 1 shows a schematic view of a paper sorter in accordance with the principles of this invention. Specifically, FIG. 1 shows a tray set 10 movable along an axis into and out of the plane of the paper as viewed in the figure. The mechanism for moving the trays to open a space at the position selected during operation is mounted on cam housings or vertical support frames 11 and 12 which are movable along axes parallel to the above-noted axis as is discussed more fully hereinafter. The papers to be delivered to the selected tray during each operation is inserted by a paper chute at the selected position from beneath the trays. The sorter, in the illustrative embodiment, is designed to accept papers from an electronic printer to which the sorter is attached so that the paper chute is connected to the output of the printer.

Figure 3:
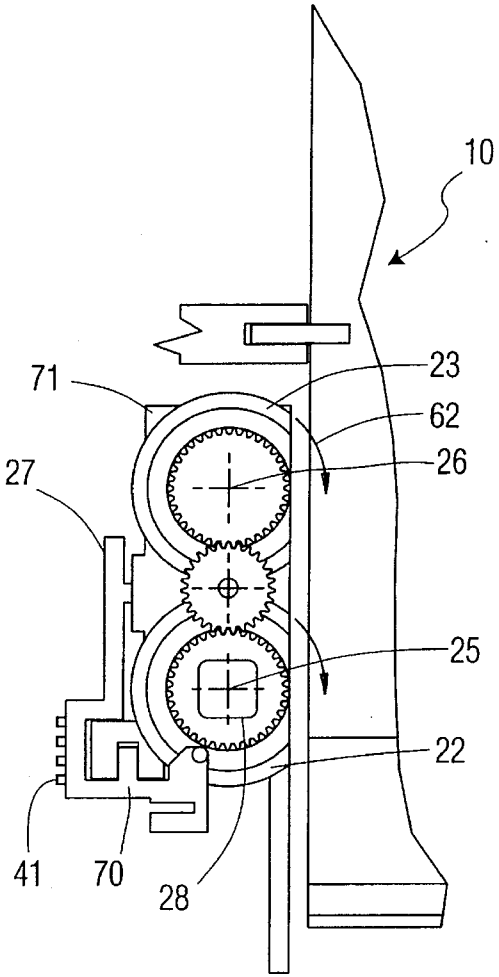
FIGS. 2 and 5 and 3 and 6 are schematic side views and schematic end views of the mechanical tray movement mechanism of the tray assembly of FIG. 1.
Figure 2:
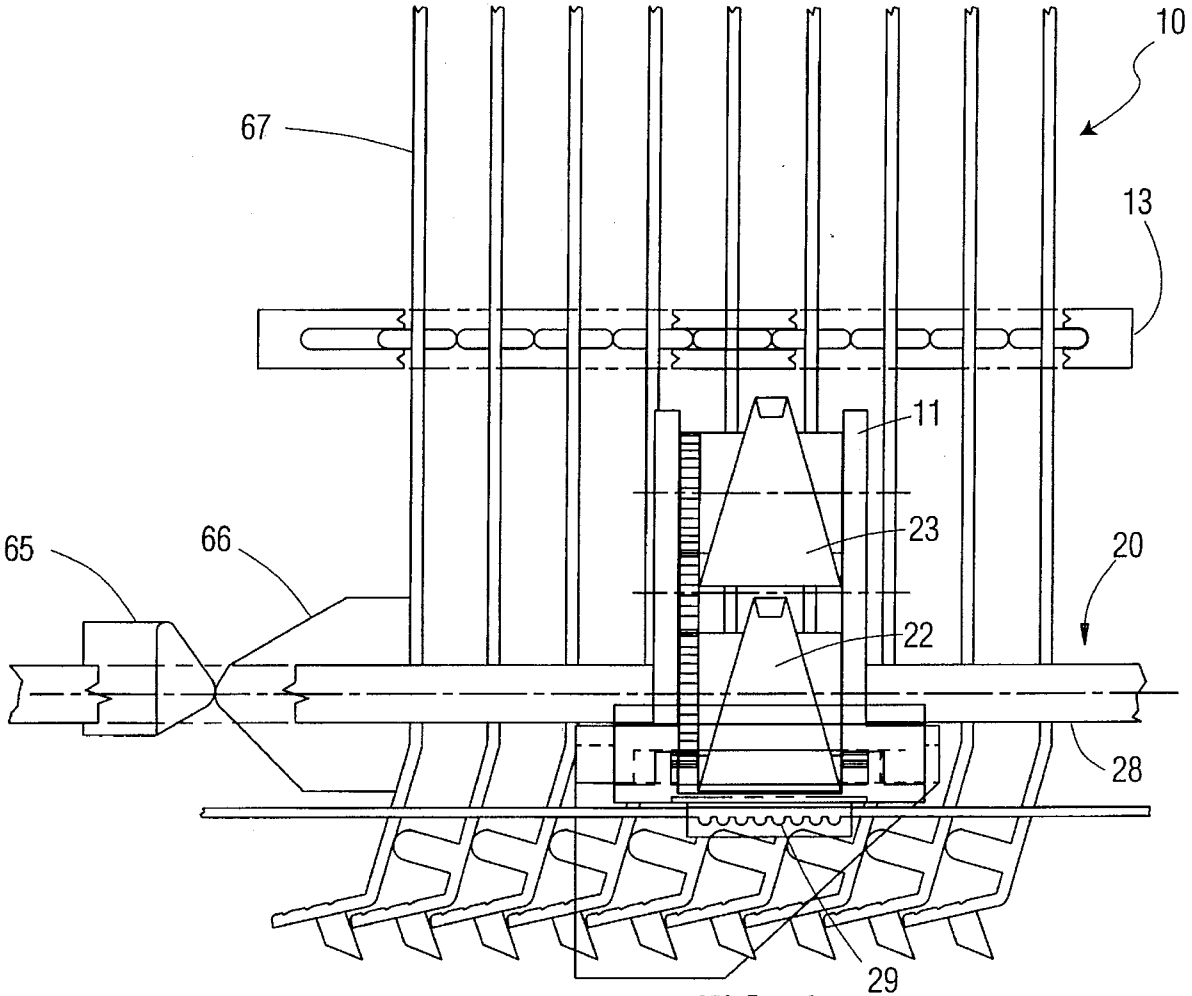

FIGS. 2 and 3 are schematic side views of the tray moving subassembly 20 and a schematic side view of that subassembly. Each support frame 11 and 12 of FIG. 1 contains a tray moving subassembly. FIG. 2 shows nine trays of the tray set 10 of FIG. 1. The trays, as viewed in FIG. 2, move from right to left, or into and out of the paper as viewed in FIG. 1.

The tray set subassembly need only be sufficiently large to contain the tray set with the trays touching one another, as shown in FIG. 2, plus a space to allow for an increased separation between a selected tray and the next adjacent tray, a space which need only be one quarter of an inch rather than the minimum one and one quarter to one and one half inch required in prior art sorters. A set of slide blocks (13 of FIG. 2) provides stability for the trays yet allows the slight movement of the tray set to enable the increased space at the selected tray to be achieved.

That increased space between the selected tray and the next adjacent tray is provided by cams or wedges 22 and 23 of the tray-moving subassembly as shown in FIG. 2. Only one of the wedge-moving subassemblies includes two wedges, an extra one for achieving increased stability in tray movement. The other subassembly includes only one wedge. But since the wedges all work in concert, the description of the wedges along with the mechanism to move a wedge will be understood to be operative to move all the wedges.

Specifically, wedges 22 and 23 rotate around axes 25 and 26, respectively, as shown in FIG. 3. Wedges 22 and 23 are supported by frame 11 which travels along rod 28. The movement of frame 11 is produced by a motor driven belt which engages gear 29 shown at the bottom of frame 11 as viewed in FIG. 2. The belt is designated 30 in FIG. 1.

Figure 4:
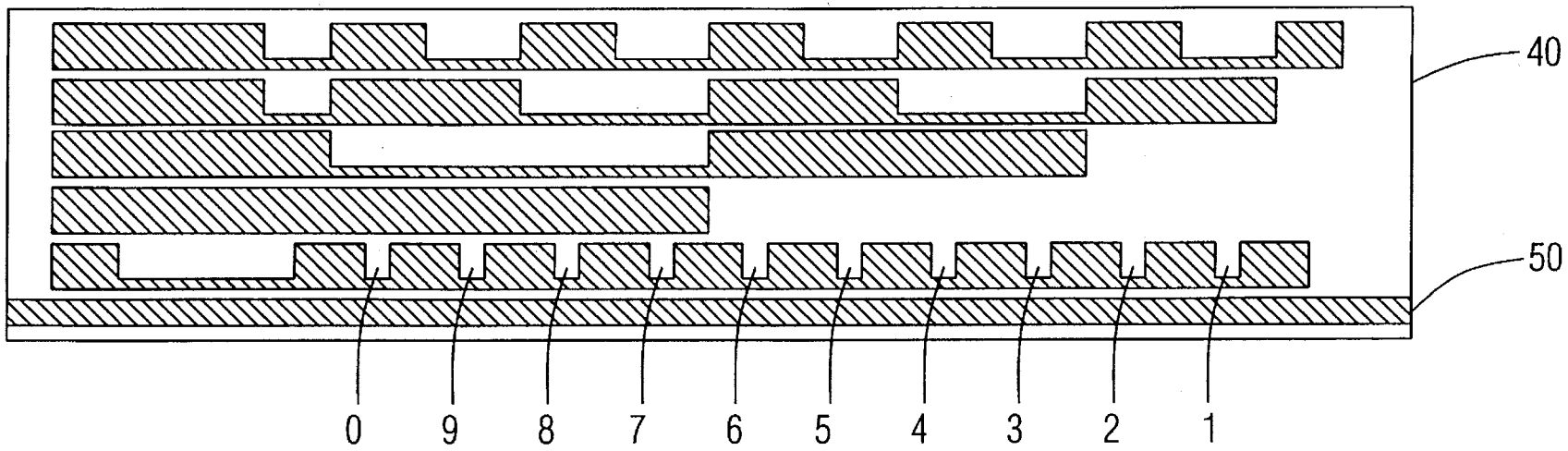
FIG. 4 is a schematic representation of a binary coded control arrangement for the movement of the trays of FIG. 1.

The position to which the belt moves the frame (11) is determined, illustratively, by a binary code arrangement 40 attached to the inside face of a housing (not shown) in a position to engage wiper fingers 41 of frame 11. The coded arrangement need only be about four inches long and need only deliver the pulses shown on FIG. 4 for the selection of the trays, ten positions for the spacing for the nine trays of FIG. 2 responsive to signals from the printer to which it is attached. To this end, printers and copiers for which sorters in accordance with the principles of this invention are designed, include means for controlling attached sorters. Such a means is well understood in the art and is not discussed herein. Suffice it to say that a sorter herein is responsive to such means to drive a motor, not shown, to activate the belt to move frame 11 to a position determined by code 40. For determining the exact position for the frame, electrical contacts are attached to each of the six lines of code shown for the binary coded arrangement, the bottom line 50, conveniently being grounded. Power is supplied to the motor driving the belt until the wiper fingers signal that the selected coded position is reached. Once the selected position for frame 11 is reached, rod 28 is rotated one revolution thus rotating the wedges to separate the trays at the selected position.

Figure 6:
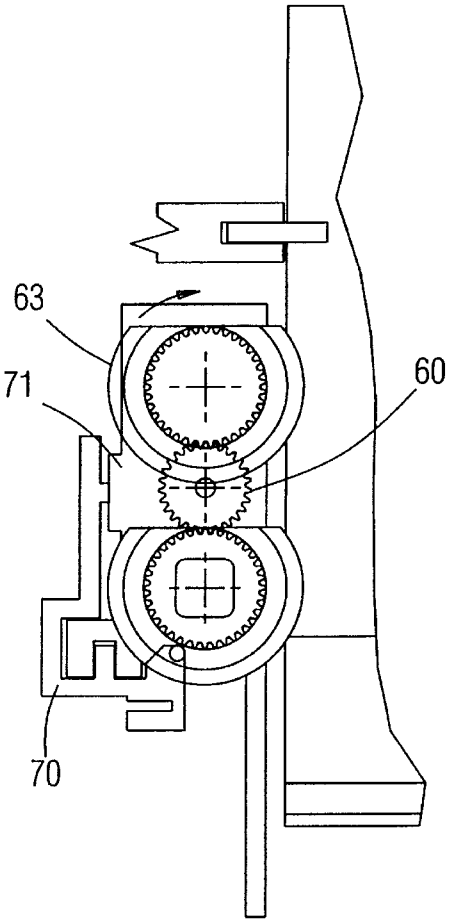
Figure 5:
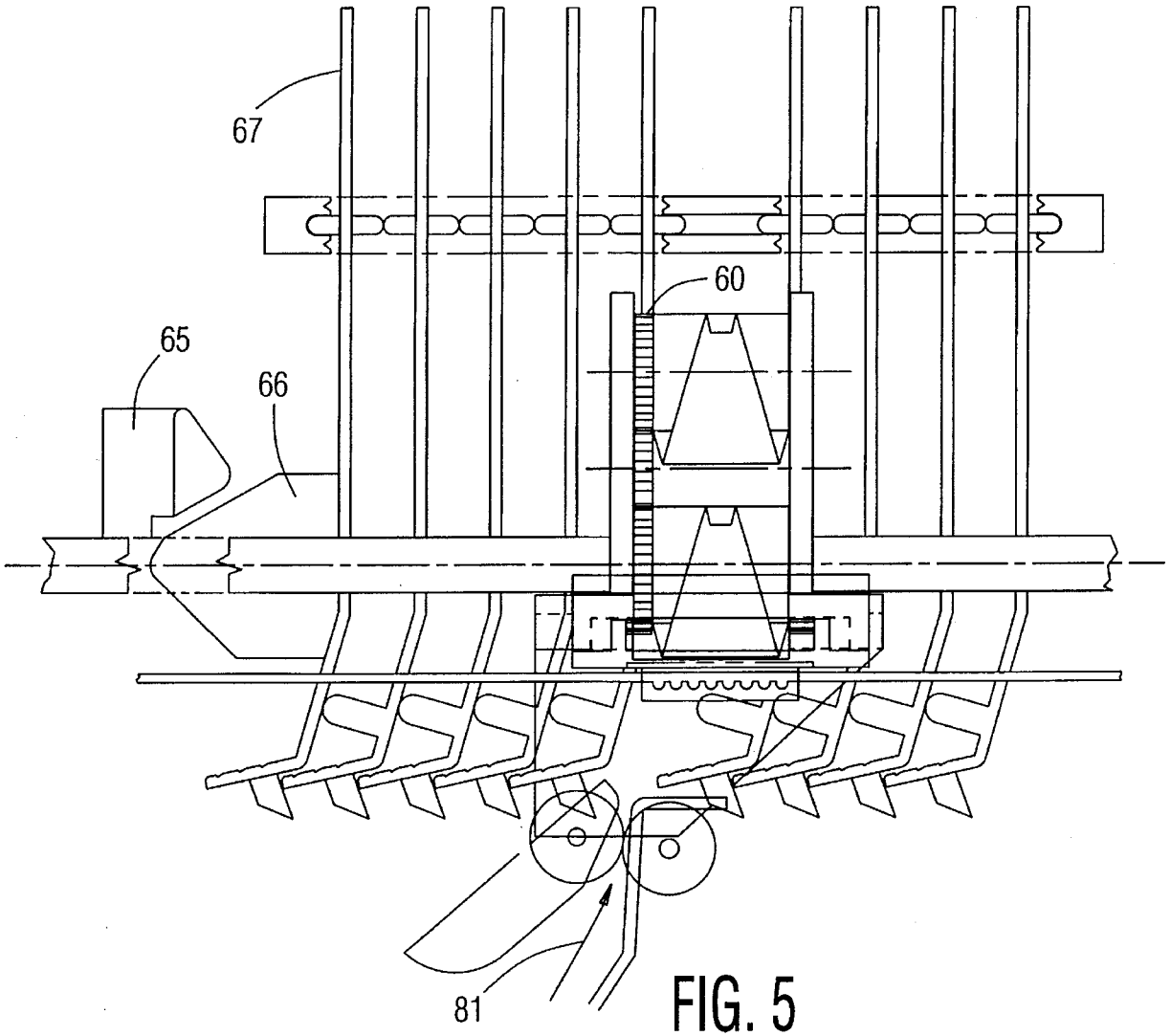

The wedges are rotated by gear train 60, responsive to the rotation of rod 28 as shown in FIGS. 5 and 6. The trays are shown separated at position five as shown in FIG. 5, the wedges having been rotated one revolution as indicated by the curved arrows 62 and 63 of FIGS. 3 and 6. Rod 28 is connected into gear train 60 at one end, that gear train being motor driven and responsive to the deactivation of the motor driving the belt. Rod 28 also includes a cam 65 which rotates with the rod and engages cam follower 66 extending from the end tray 67 of the tray set as shown in FIGS. 2 and 5. The cam is shown in the "no tray separation" position and in the "tray separation" position as shown in FIGS. 2 and 5 respectively. The cam operates to reset the trays to the right as viewed in FIGS. 2 and 5, thus readying the trays for the next operation. Note that frame 11 remains in the position shown until directed to a new position and is not returned to a reference position between operations.

In the preferred embodiment the wedges are free to move slightly laterally within the side walls of frame 11. To this end, frame 11 actually is composed of two components 70 and 71 as shown in FIGS. 3 and 6.

Figure 7:
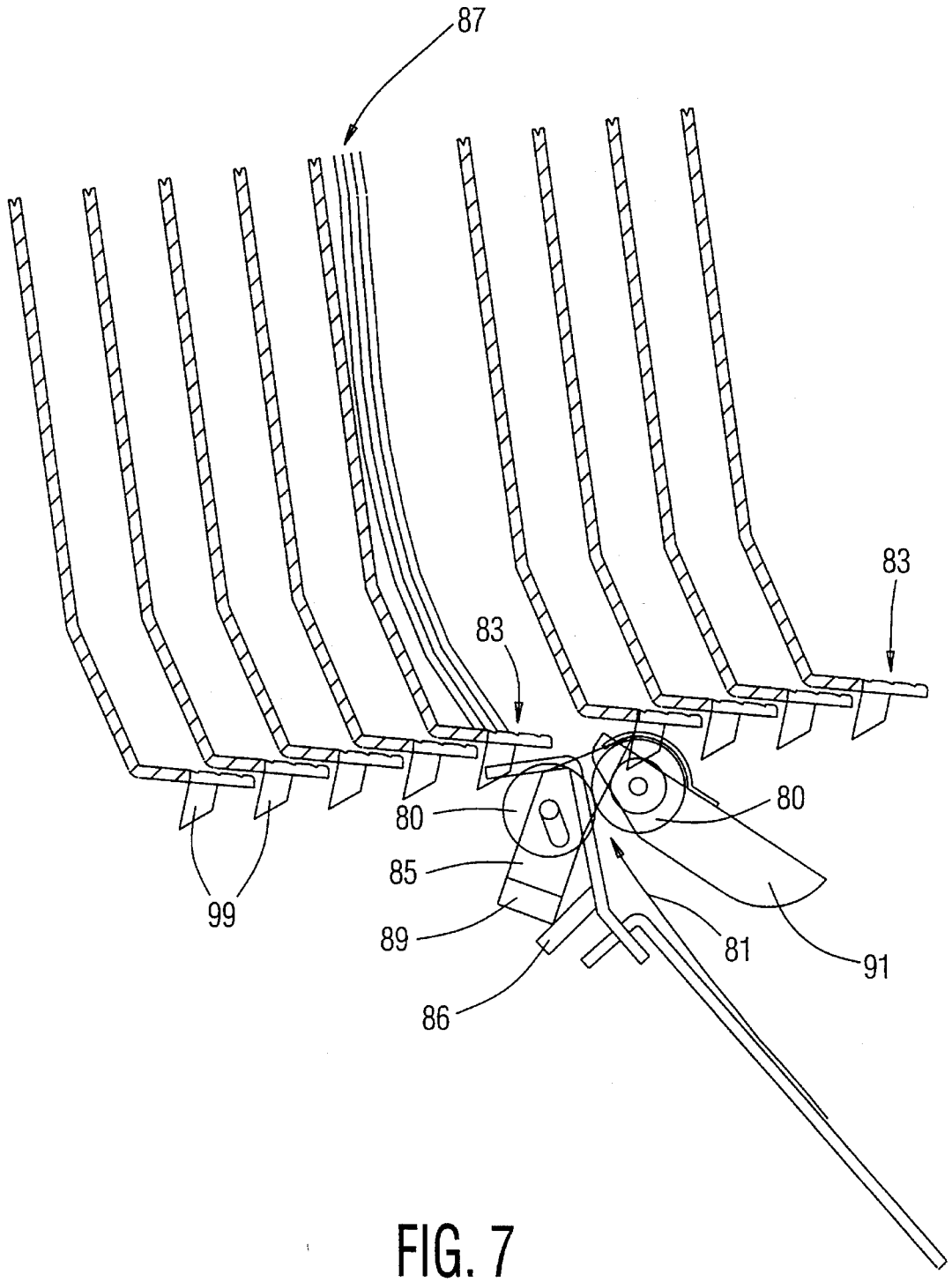
FIGS. 7 and 8 are schematic representations of the mechanical paper chute movement mechanism for delivering paper sheets to the tray assembly of FIG. 1.

FIG. 7 shows the paper chute positioned at the selected tray to move a paper sheet into the tray where the increased space permits. The paper chute subassembly is suspended from frames 11 and 12 of FIG. 1 and travels along an axis parallel to that of rod 28 of FIG. 2 to the position to which the wedges are moved during each operation.

Once the paper chute is moved to the selected position, rollers 80 are activated in response to the sensing of the presence of a sheet of paper in the chute. The sensing of the paper and the means for doing so is standard in sorter equipment and is not discussed further herein. A third motor (not shown) is geared to rollers 80 to propel a sheet of paper in the direction indicated by arrow 81 in FIG. 8. The paper is propelled with considerable force up into the tray selected and falls down onto the lip of the tray where it is caught by striations in the lip as shown at 83.

Figure 8:
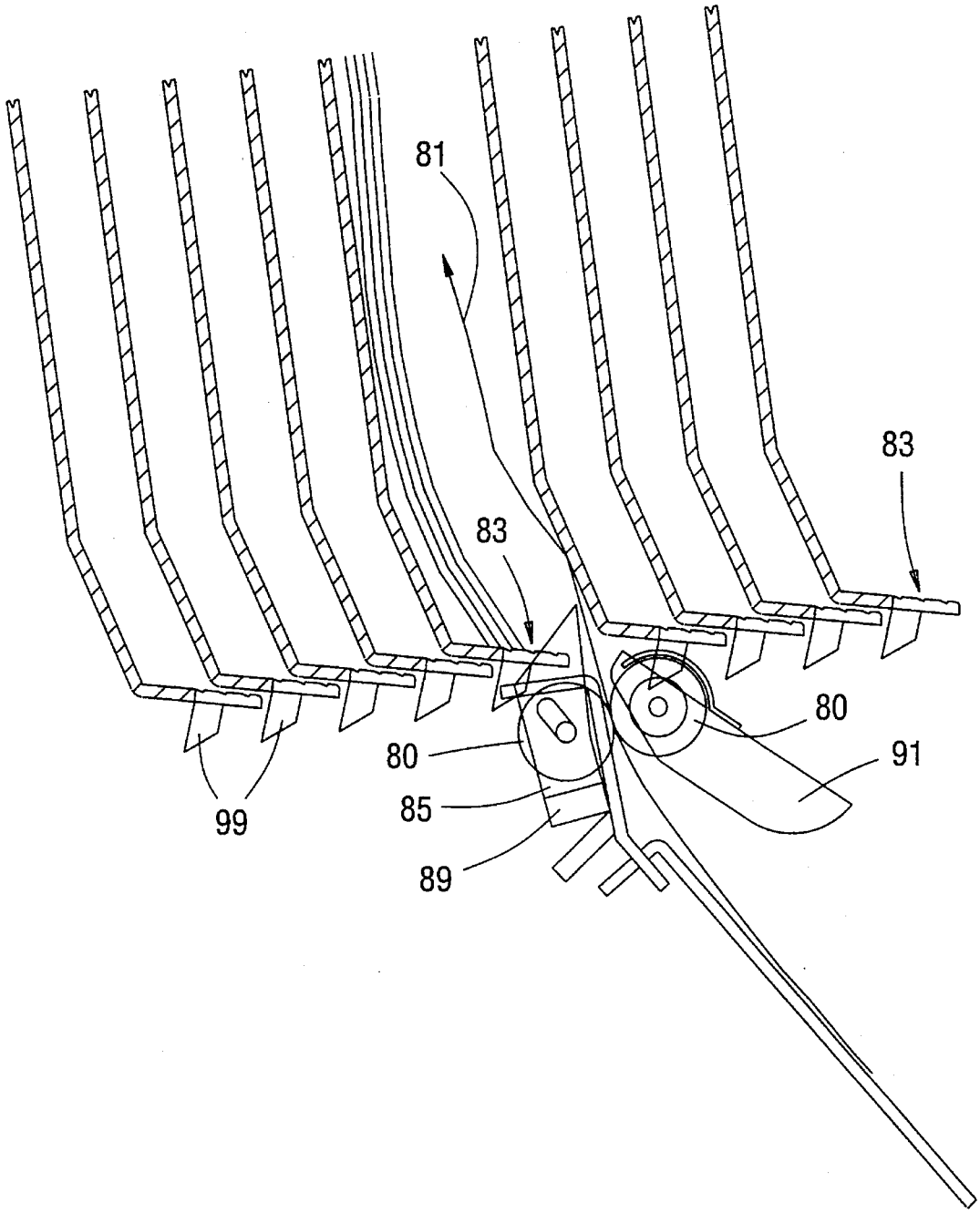

When a sheet of paper is propelled upwards by the rollers, it engages teeth 85 rotating the teeth up into slots in the tray lip. The bottom of the teeth engages ramp 86 thus causing the teeth to lift upwards to catch the bottom of the most recently delivered sheet of paper to push the paper into the stack 87 as shown in FIGS. 7 and 8. A comparison of the positions of the teeth 85 in FIGS. 7 and 8 indicates the action of the teeth in repositioning a sheet of paper. The teeth are weighted at 89 so that they fall back into the position shown in FIG. 7 after the sheet of paper passes thus blocking any undesirable movement of the papers.

After the positioning of a sheet of paper, the tray set is repositioned by the action of cam 65 of FIG. 2 thus causing the trays to nest closely, moving teeth 99 and teeth 91 to push into place any sheet of paper not properly positioned by teeth 80. The various teeth sets 80, 99 and 91 herein are arranged like teeth of combs which interleave with one another.

Figure 9:
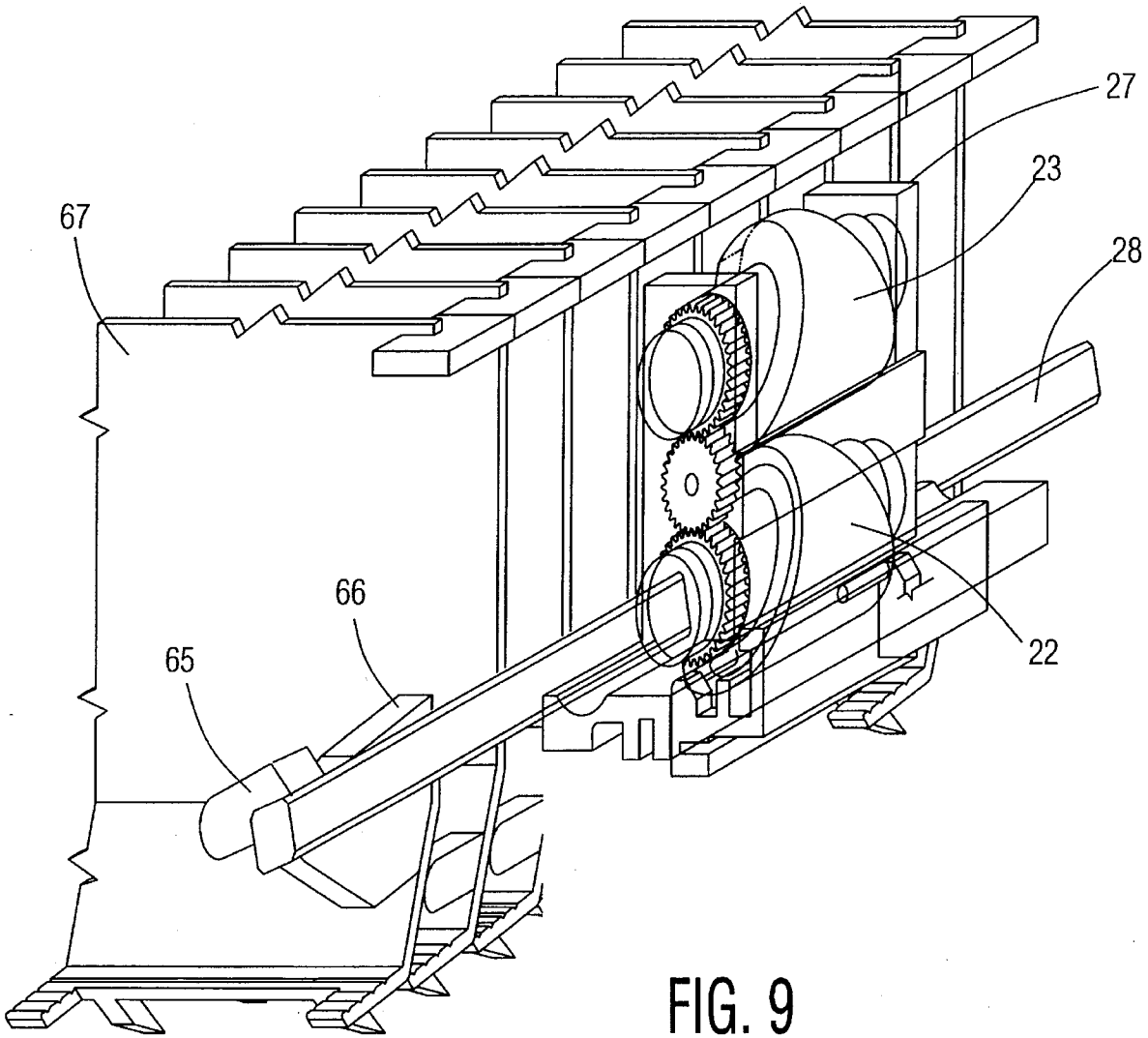
FIG. 9 is a schematic representation of the tray set adjustment mechanism of the sorter of FIG. 1.

FIG. 9 shows a schematic projection view of the wedge moving subassembly on one side of the tray set. Rod 28 includes a switch (not shown) at each end thereof positioned at ninety degrees with respect to one another. The switches are set upon each rotation of rod 28, one switch responding to the up and down orientation of the rod to allow the wedges to rotate, the second switch to indicate that the wedges are not rotated into position between trays and the frame 27 is free to move.

Figure 10:
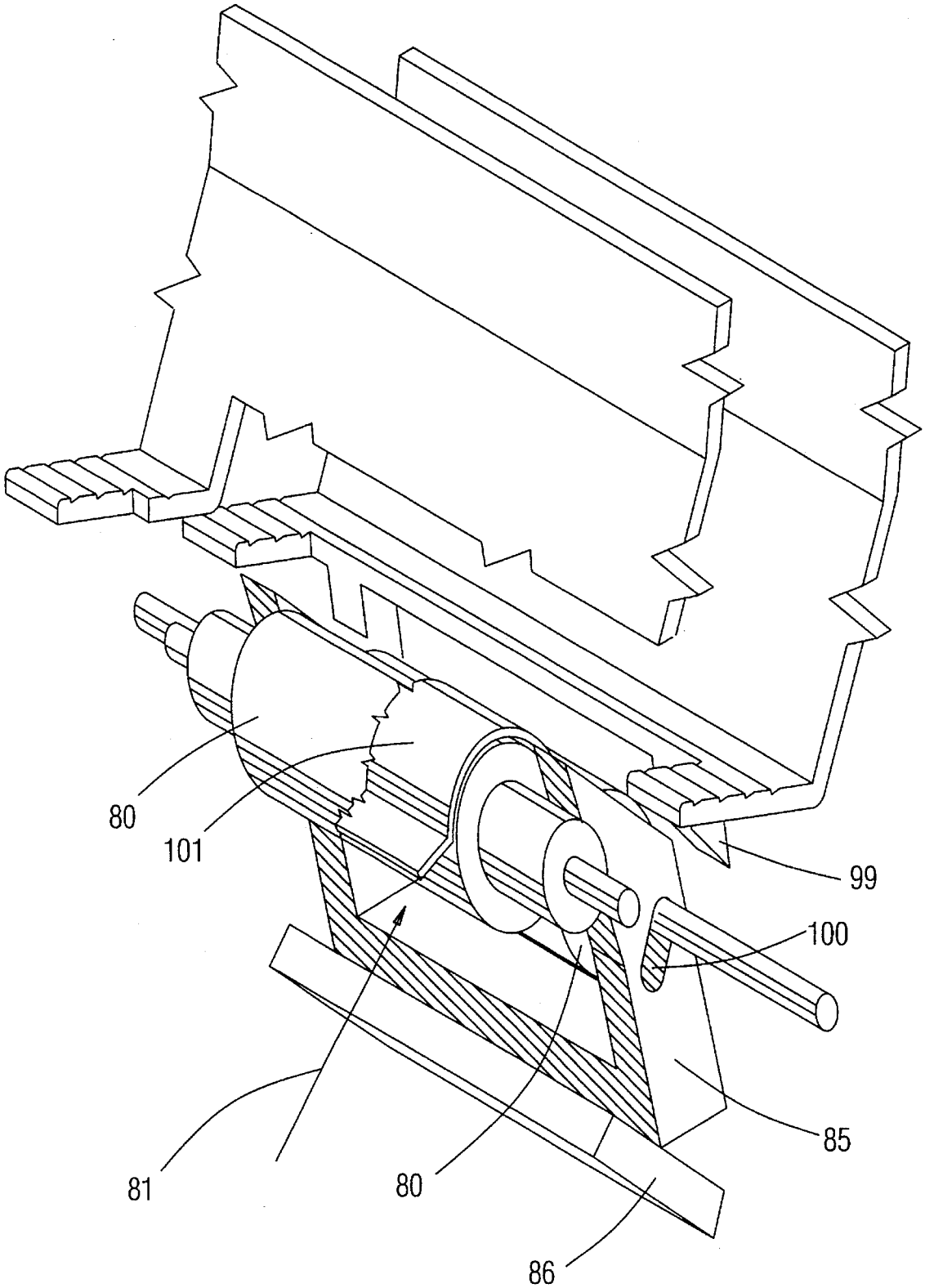
FIG. 10 is a schematic representation of the sheet positioning mechanism of the sorter of FIG. 1.

FIG. 10 is a schematic projection view of a portion of illustrative trays of the tray set showing the relationship between teeth 85, ramp 86 and teeth 99. Slot 100 in the assembly for teeth 85 permits the assembly to ride up along ramp 86 in response to a moving sheet of paper. Shield 101 also is present to restrain any improper movement of a sheet of paper around the rollers (80) rather than into the spacing selected.

FIG. 1 shows, schematically, the relationship between the tray moving mechanism of FIGS. 2 and 5 and the counterpart of that mechanism on the other side of the trays. The two mechanisms are driven by a keyed drive shaft 90 (motor driven) and a cam rotation drive belt 101. Belt 101 functions to rotate cams or wedges 22 and 23 and the counterpart wedges on the other side of the tray set. In one position, the wedges rotate to separate the trays at the selected position as described above. In another position, the wedges are upright and have a flat face 103 as indicated for wedge 104 in FIG. 1 to permit movement of the wedges past the tray set.

The paper chute mechanism is attached to the bottom of the frames 11 and 12 and thus is positioned to introduce a sheet of paper to the selected position by virtue of the mechanical relationship between the chute and the frames in the illustrative embodiment. The opposite end of the paper chute is attached to the output of the printer or copier with which it is operating. Thus, the paper chute is flexible to allow movement over the small distances required.

A sorter in accordance with the principles of this invention can be seen to be compact because the trays nest and only a relatively small separation at only a selected tray need be provided. Further, only a very small movement occurs during operation and there is no need to move all the trays as is necessary with prior art movable tray sorters. Thus, weight can be relatively low as well as power leading to a dramatically low cost sorter which employs three small and low power motors, mostly plastic components and a simple control mechanism.

What is claimed is:

1. A movable tray sorter, said sorter including a plurality of trays and means for enabling movement of said trays along an axis, said sorter also including control means for moving a subset of said tray set one position for forming a relatively large separation between any selected tray and the next adjacent tray where said subset comprises from 1 to N–1 trays for an N tray sorter, said sorter also including a paper chute and means for moving said paper chute along said axis directly from it's present position to a position in alignment with said separation for delivering a paper sheet to said selected tray wherein the trays of said tray set are arranged generally vertically and said axis is a horizontal axis, said trays being in closely spaced positions and said paper chute is positioned beneath said tray set.

2. A paper sorter as set forth in claim 1 wherein each of said trays includes a lip extending from the lower edge thereof wherein said lip includes a set of parallel, paper retaining striations extending laterally therealong.

3. A paper sorter as set forth in claim 2 also including a movable finger subassembly responsive to the reduction of the separation between the last selected tray of said tray set and the tray adjacent thereto for setting the position of the papers in the last selected tray, said sorter including mechanical means for reducing said separation responsive to the selection of a next tray for paper delivery under the control of said control means.

4. A paper sorter as set forth in claim 1 wherein said control means comprises a binary logic arrangement for generating coded signals for selecting a tray of said tray set for movement of said tray set along said horizontal axis in a manner to increase the separation between said selected tray of said tray set and said next adjacent tray in response to the selection of a tray of said tray set for the delivery of a paper sheet thereto.

5. A paper sorter as set forth in claim 4 wherein said control means also includes means responsive to said coded signals for moving said paper chute to the position of said increased separation.

6. A movable tray sorter as in claim 1 wherein the trays of said set of trays are nested in parallel planes, said sorter including means for controllably freeing said trays for movement along an axis normal to said planes, said sorter alos including means for moving only a subset of from 1 to N–1 trays said tray set along said axis for opening a paper-receiving space between a selected one of said trays and a next adjacent tray.

7. A movable tray sorter as in claim 6 also including control means for selecting the position of said space.

8. A movable tray sorter as in claim 7 wherein said means for controllably freeing comprises a rod arranged along said axis and said means for opening said space includes a frame and means for moving said frame along said rod said frame including a rotatable wedge and means for rotating said wedge between adjacent trays at a selected position.

9. A sorter as in claim 8 wherein said control means includes a binary coded pattern of conductors and a matching set of fingers on said frame positioned to engage said pattern for determining the position of said space.

10. A sorter as in claim 9 wherein said subset of trays includes an end tray, said end tray including a cam follower, the associated end of said rod including a cam, said cam engaging said cam follower for moving said subset of trays in a manner to eliminate said space in response to each rotation of said rod.

11. A sorter as in claim 10 including a paper chute and means for moving said paper chute to said space.

12. A movable tray sorter as in claim 1 wherein the trays of said set of trays are in contact with one another and arranged in parallel planes and wherein said control means includes means for controllably freeing said trays to move along an axis transverse to the planes of said trays, said sorter including a tray support subsystem of a configuration to constrain said tray set to a space equal to that occupied by said tray set with all the trays nested in contact with one another plus the space required at a selected position for receiving a sheet of paper.

13. A sorter as in claim 12 wherein each of said trays is oriented upwards and includes a lip at it's lower edge to catch sheets of paper introduced into said space, said lip including striations to catch said sheet of paper.

14. A sorter as in claim 13 wherein each of said trays includes a set of teeth extending from the lower surface of said lip, said teeth being operative to engage the lower edge of a sheet of paper introduced into said space when the trays of said subset are urged into their nesting positions.

15. A paper sorter as in claim 1 wherein said means for moving said paper chute is mechanically connected to said means for moving said tray set.

16. A paper sorter as in claim 1 including slide blocks connecting all of the trays of said set, said slide blocks being of a geometry to permit slight movement of said trays.

* * * * *